US009235957B2

(12) United States Patent
Gagner et al.

(10) Patent No.: US 9,235,957 B2
(45) Date of Patent: Jan. 12, 2016

(54) EVENT BASED PUBLISHING/SUBSCRIBING IN A WAGERING GAME NETWORK

(71) Applicant: WMS Gaming, Inc., Waukegan, IL (US)

(72) Inventors: Mark B. Gagner, West Chicago, IL (US); Damon E. Gura, Chicago, IL (US); Larry J. Pacey, Northbrook, IL (US); Alfred Thomas, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 213 days.

(21) Appl. No.: 13/920,544

(22) Filed: Jun. 18, 2013

(65) Prior Publication Data

US 2013/0281204 A1 Oct. 24, 2013

Related U.S. Application Data

(63) Continuation of application No. 13/128,649, filed as application No. PCT/US2009/063769 on Nov. 9, 2009, now Pat. No. 8,480,497.

(60) Provisional application No. 61/113,457, filed on Nov. 11, 2008.

(51) Int. Cl.
*A63F 9/24* (2006.01)
*G07F 17/32* (2006.01)

(52) U.S. Cl.
CPC ..... *G07F 17/3241* (2013.01); *G07F 17/32* (2013.01); *G07F 17/3255* (2013.01); *G07F 17/3283* (2013.01)

(58) Field of Classification Search
CPC ..... G06F 17/32
See application file for complete search history.

(56) References Cited

U.S. PATENT DOCUMENTS

| | | | |
|---|---|---|---|
| 7,384,339 | B2 | 6/2008 | LeMay et al. |
| 2002/0196342 | A1 | 12/2002 | Walker et al. |
| 2005/0043090 | A1 | 2/2005 | Pryzby et al. |
| 2005/0064926 | A1 | 3/2005 | Walker et al. |

(Continued)

FOREIGN PATENT DOCUMENTS

| | | |
|---|---|---|
| WO | WO-2010056626 | 5/2010 |

OTHER PUBLICATIONS

"PCT Application No. PCT/US09/63769 International Preliminary Report on Patentability", Feb. 3, 2011, 9 pages.

(Continued)

*Primary Examiner* — Omkar Deodhar
(74) *Attorney, Agent, or Firm* — DeLizio Law, PLLC

(57) ABSTRACT

A publisher-subscriber architecture with standardized and/or dynamic event/message look up can be implemented on wagering game establishment networks to establish a robust and flexible reporting and reacting mechanism. Processes that operate in accordance with the publisher-subscriber architecture can coordinate operations across multiple devices in a wagering game establishment, and even across multiple wagering game establishments, in response to an event occurring. Processes can operate as publishers and/or subscribers, and can reside on a WGM (e.g., standalone, portable, etc.) or a server. Processes operating as publishers on a WGM can publish information about events that occur on the WGM. Processes operating as subscribers can interpret published event information from different vendors and use published event information in a number of different ways.

7 Claims, 13 Drawing Sheets

(56) References Cited

U.S. PATENT DOCUMENTS

| | | | | |
|---|---|---|---|---|
| 2006/0259361 | A1* | 11/2006 | Barhydt et al. | 705/14 |
| 2007/0197294 | A1 | 8/2007 | Gong | |
| 2007/0218982 | A1 | 9/2007 | Baerlocher | |
| 2008/0070699 | A1 | 3/2008 | Park | |
| 2011/0244949 | A1 | 10/2011 | Gagner et al. | |

OTHER PUBLICATIONS

"PCT Application No. PCT/US09/63769 International Search Report", Jan. 8, 2010 , 9 pages.
"U.S. Appl. No. 13/128,649 Office Action", Oct. 30, 2012 , 6 pages.
"U.S. Appl. No. 13/932,739 Office Action", Aug. 20, 2015, 7 Pages.

* cited by examiner

EVENT BASED PUBLISHING/SUBSCRIBING IN A WAGERING GAME NETWORK

RELATED APPLICATIONS

This application is a continuation application that claims benefit of U.S. application Ser. No. 13/128,649 which is a National Stage Application of PCT/US09/63769 filed 9 Nov. 2009, which claims benefit of Provisional U.S. Patent Application No. 61/113,457 filed 11 Nov. 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2008, WMS Gaming, Inc.

FIELD

Embodiments of the inventive subject matter relate generally to wagering game systems, and more particularly to causing an activity to occur across multiple devices in response an event occurrence.

BACKGROUND

Electronic wagering game machines (WGMs), such as slot machines, video poker machines and the like, have been a cornerstone of the gaming industry for several years. Electronic WGMs are capable of collecting and reporting an enormous amount of information. Because casinos are interested in providing interesting and exciting gaming experiences, a single casino may operate a wide variety of WGMs produced by a number of different manufacturers.

BRIEF DESCRIPTION OF THE FIGURES

The present embodiments may be better understood, and numerous objects, features, and advantages made apparent to those skilled in the art by referencing the accompanying drawings.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. For instance, although examples refer to floor standing wagering game machines, embodiments may be implemented in other types of wagering game machines including handheld models, bartop models, etc. In other instances, well-known instruction instances, protocols, structures and techniques have not been shown in detail in order not to obfuscate the description.

Analyzing information reported by WGMs utilizing different reporting mechanisms can be difficult and cumbersome especially if information is presented in several different formats. A publisher-subscriber architecture with standardized and/or dynamic event/message look up can be implemented on wagering game establishment networks to establish a robust and flexible reporting and reacting mechanism. Processes that operate in accordance with the publisher-subscriber architecture can coordinate operations across multiple devices in a wagering game establishment, and even across multiple wagering game establishments, in response to an event occurring. Processes can operate as publishers and/or subscribers, and can reside on a WGM (e.g., standalone, portable, etc.) or a server. Processes operating as publishers on a WGM can publish information about events that occur on the WGM. Examples of events include a win, a beverage order, a bonus condition being met in a wagering game, a wager, etc. Processes operating as subscribers can interpret published event information from different vendors and use published event information in a number of different ways. For example, a subscriber can initiate a casino wide promotion in response to a game condition being published in an event. As another example, a first subscriber can notify a hospitality system of published event information that indicates a beverage order, while a second subscriber extracts useful data from the published beverage order for statistics on the types of beverages ordered in the casino.

Figure 1:
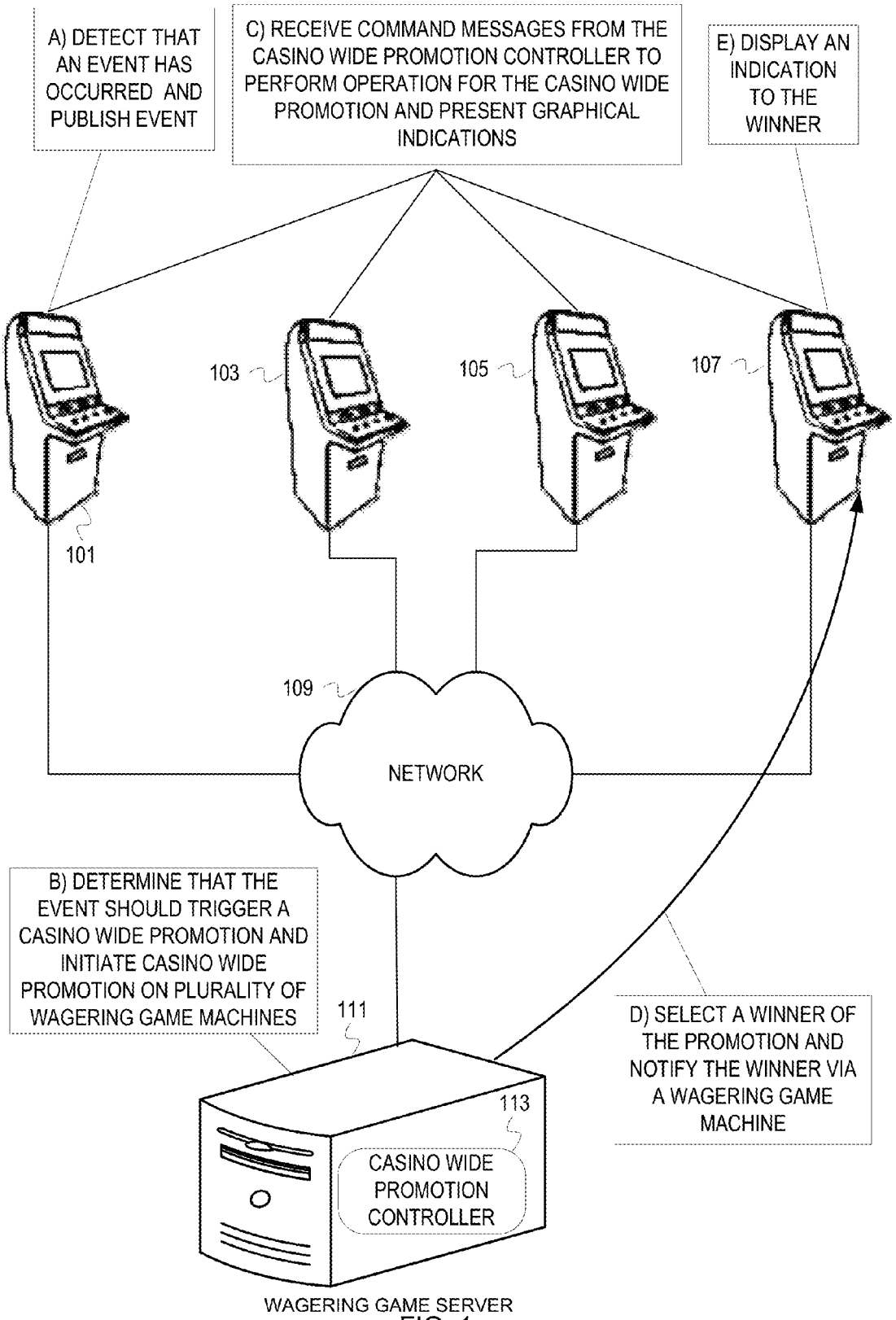
FIG. 1 is an example conceptual diagram of triggering a casino wide promotion based on a published event.

FIG. 1 is an example conceptual diagram of triggering a casino wide promotion based on a published event. A plurality of WGMs exist in a casino. The plurality of WGMs comprise a WGM 101, a WGM 103, a WGM 105, and a WGM 107. WGMs 101, 103,105, and 107 are communicatively coupled to a wagering game server 111 via a network 109. The wagering game server 111 hosts a casino wide promotion controller 113.

At stage A, a process operating as a publisher ("publisher process") on the WGM 101 detects that an event has occurred and publishes the event. Examples of events include a win, a wager, a beverage order, a spin, etc. Publishing an event comprises providing information about the event to interested entities (e.g., subscriber processes). Examples of providing information include transmitting a message to a recipient, posting a message to a central database, notifying a recipient of a location to access data about the event, etc. In FIG. 1, published the detected event comprises the publisher process on the WGM 101 transmitting a message over the network 109 to the wagering game server 111. The casino wide promotion controller 113 has previously subscribed to the type of event published and/or the publisher process on the WGM 101. Embodiments are not limited to implementing subscriber entities on a wagering game server. A subscriber entity may reside on a variety of devices.

At stage B, the casino wide promotion controller 113 determines that the event should trigger a casino wide promotion and initiates the casino wide promotion on WGMs 101, 103, 105, and 107. For example, the casino wide promotion controller 113 examines the message from the publisher process and to determine event information elements, perhaps including an event identifier and/or event type indicator. The casino wide promotion controller 113 can then map the event information elements to data that causes initiation of the casino wide promotion (e.g., function pointer, command name, etc.). For the example depicted in FIG. 1, the casino wide promotion controller 113 transmits command messages to the WGMs 101, 103, 105, and 107 to cause the WGMs 101, 103, 105, and 107 to perform operation for the casino wide promotion and present one or more graphical indicators of the casino wide promotion. Examples of casino wide promotions include a slot tournament, a random drawing, playing of an animation sequence, etc. In addition, the casino wide promotion controller 113 can initiate different casino wide promotions and/or a casino wide promotion that involves multiple activities based on the published event. For example, a condition in a game, such as bonus symbols lining up on a slot machine payline, may be an event. Information indicating the game condition is transmitted to the casino wide promotion controller 113. The casino wide promotion controller 113 determines that the event is a trigger for a casino wide promotion that involves a random drawing and an animation sequence to be played across multiple large screen displays. The casino wide promotion controllers 113 cause a group of wagering game machines to execute code to allow players at the group of wagering game machines to participate in the random drawing. The casino wide promotion controller 113 also causes a group of displays that corresponds to the group of wagering game machines to play an animation sequence that corresponds to the random drawing.

At stage C, the WGMs 101, 103, 105, and 107 receive the respective command messages from the casino wide promotion controller 113, and begin performing operations for the casino wide promotion. The WGMs 101, 103, 105, and 107 also present graphical indicators of the casino wide promotion (e.g., display a text and images indicating a random drawing).

At stage D, the casino wide promotion controller 113 selects a winner of the promotion and notifies the winner via the WGM 107. The notification may be transmitted to the WGM 107 by a protocol message, a published event where the casino wide promotion controller 113 publishes the event to a subscriber process on the WGM 107, etc. For example, the casino wide promotion controller 113 randomly selects the WGM 107, and transmits a notification to the WGM 107 to notify a player at the WGM that the player has won.

At stage E, WGM 107 displays an indication to the winner. The casino wide promotion controller 113 may also cause the other WGMs 101, 103, and 105 to notify participants of the win. For example, lights on top of the plurality of WGMs light up randomly until stopping on the WGM where the winner is playing. The persistent light indicates the winner, and a prize is awarded to the winner.

Figure 2:
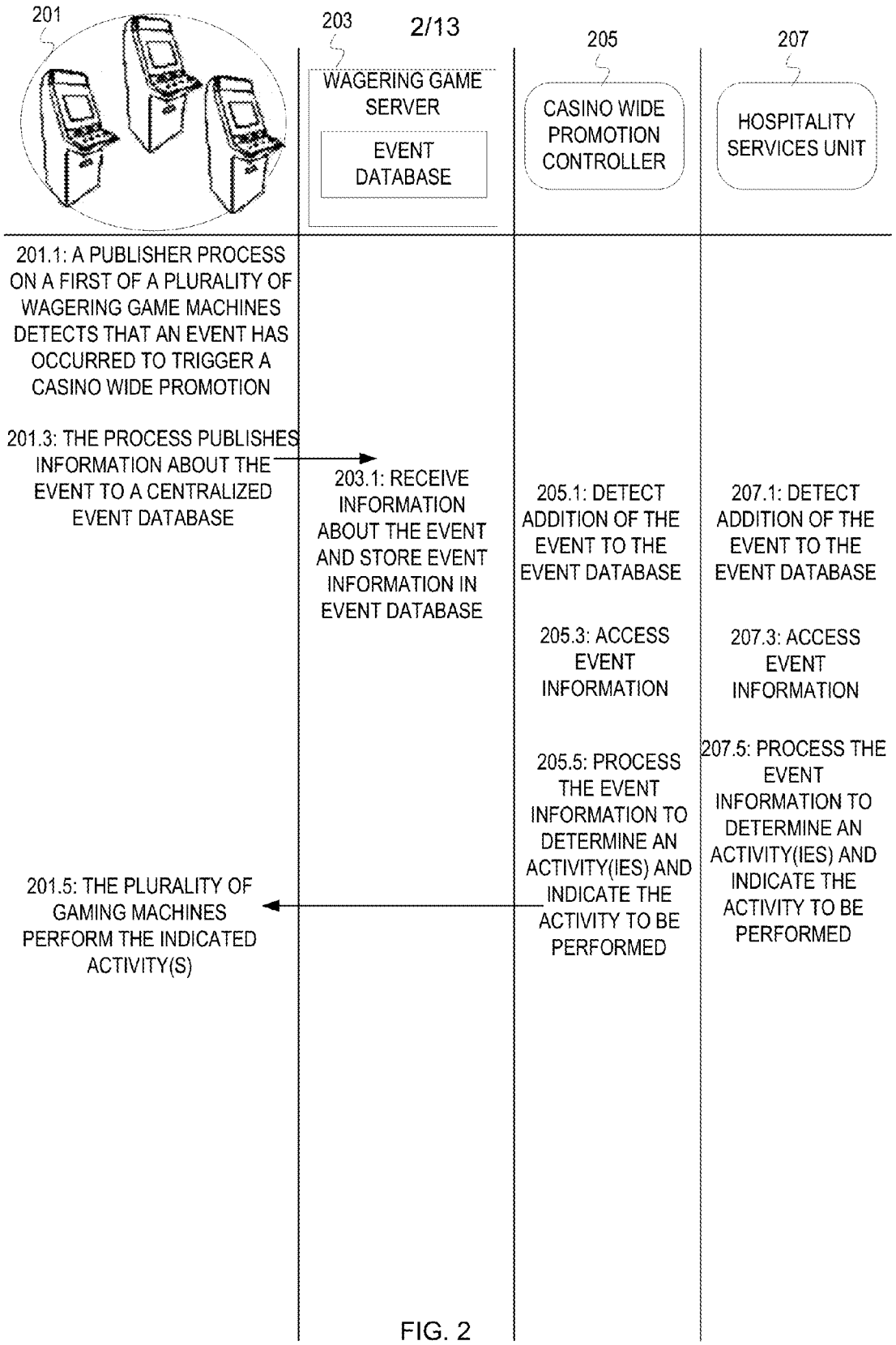
FIG. 2 is an example conceptual diagram of publishing events to a centralized event database.

FIG. 2 is an example conceptual diagram of publishing events to a centralized event database. At stage 201.1, a publisher process on a first of a plurality of WGMs 201 detects that an event has occurred. For example, an event occurs when a jackpot reaches a certain amount on the first WGM.

At 201.3, the process publishes information about the event to a centralized event database on a wagering game server 203. For example, the publisher process transmits a message that indicates the event to the wagering game server 203. Although the centralized event database is depicted on the wagering game server 203, the event database may be on a network drive, second server, etc.

At 203.1, the wagering game server 203 receives information about the event and stores the event information in the event database. Examples of the wagering game server 203 storing information about the event includes storing the information at a memory location, appending a file with the event information, updating a data structure with the event information, etc. One or more subscribers can access the event database. In this example, a casino wide promotion controller 205 and a hospitality services unit 207 have subscribed to the event and/or publisher process. The casino wide promotion controller 205 and the hospitality services unit 207 may be running on the wagering game server 203, a different server, a wagering game machine, a portable computer, etc.

At 205.1 the casino wide promotion controller 205 detects addition of the event to the event database. The casino wide promotion controller 205 can detect addition of the event by monitoring a block of memory in the event database, checking a modified date of a file, etc. In addition, the wagering game server 203 may send a notification message to the casino wide promotion controller 205 when a new event is added to the event database.

At 205.3, the casino wide promotion controller 205 accesses the event information in the event database and determines a type of event based on an event identifier in the published event information. The casino wide promotion controller 205 may be subscribed to different types of events. The casino wide promotion controller 205 can determine how to process the event information based on the event identifier. For example, event information may have a standard format programmed into the casino wide promotion controller 205. In another example, the casino wide promotion controller 205 accesses a database of event types to dynamically process the event information. The casino wide promotion controller 205 can access the database of event types to determine one or more of content, format, length, etc. of a message conveying the event information. For instance, a the casino wide promotion controller 205 can assume that an event identifier or event type indicator will be encoded within a first 30 bits of a message carrying the event information. With the event identifier or event type indicator, the casino wide promotion controller 205 can access the database of event types to determine how to process the message (e.g., parse the message based on indicated data types and field lengths, invoke a specified message parser to parse the message, etc.).

At 205.5, the casino wide promotion controller 205 processes the event information to determine an activity or activities, and causes the activity or activities to be performed based on processing the event information. For example, the casino wide promotion controller 205 accesses a table and maps an event type or the event identifier to a function pointer, command message, script, etc. The event information itself may identify a command name, include script to be executed, etc. The casino wide promotion controller 205 indicates the determined activity or activities to the plurality of wagering game machines 201.

At 201.5, the plurality of gaming machines 201 begin performing the one or more activities indicated by the casino wide promotion controller 205.

At block 207.1, the hospitality services unit 207 detects addition of the event information to the event database. The hospitality services unit 207 can detect addition of the event by monitoring a block of memory in the event database, checking a modified date of a file, etc. In addition, the wagering game server 203 may send a notification message to the hospitality services unit 207 when a new event is added to the event database.

At block 207.3, the hospitality services unit 207 accesses the event information in the event database and determines a type of event based on an event identifier in the published event information. In this example, the hospitality services unit 207 determines an event identifier that corresponds to the jackpot threshold being exceeded.

At block 207.5, the hospitality service 207 processes the event information to determine one or more activities to be performed, and indicates the activities. For instance, the hospitality services unit 207 determines that a beverage special should be offered at those of the plurality of wagering game machines 201 with active players. The hospitality services unit 207 then transmits a message to the those active ones of the plurality of wagering game machines 201 to cause them to display a graphical representation of the offer. Further, the hospitality services unit 207 may determine if certain conditions are met for an activity. For instance, the hospitality services unit 207 can determine that all players who participate in the casino wide promotion initiated by the casino wide promotion controller 205 are awarded a digital coupon for a free appetizer at a restaurant. The hospitality services unit 207 communicates with the casino wide promotion controller 205 to ascertain the wagering game machine with participating players, and transmits the digital coupon to those wagering game machines.

Figure 3:
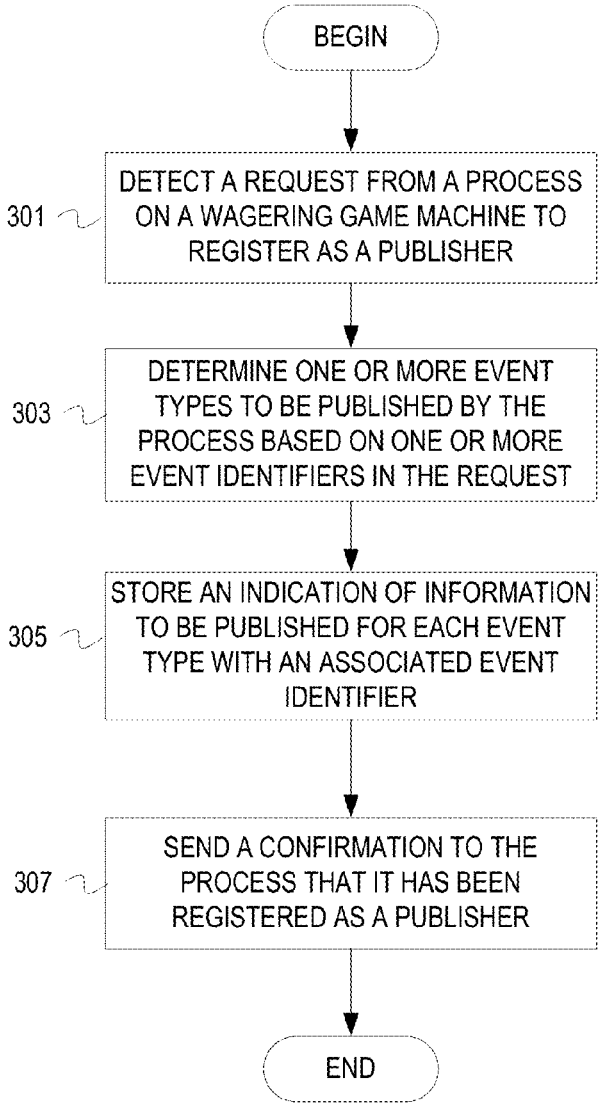
FIG. 3 is a flowchart depicting example operations for registering as a publisher with a centralized event database.

A centralized database may facilitate transfer of event information between a publisher and a subscriber. Before a publisher process can publish event information to a centralized event database it registers with the centralized event database or a process managing the centralized database. FIG. 3 is a flowchart depicting example operations for registering as a publisher with a centralized event database. Flow begins at block 301, where a centralized event database detects a request from a process on a WGM to register as a publisher. The registration request identifies the WGM associated with the process and one or more event types that the process publishes.

At block 303, the centralized event database determines the one or more event types to be published by the process based on one or more event identifiers in the registration request. For example, a process publishes both win events and wagering events.

At block 305, the centralized event database stores an indication of information to be published for each event type with an associated event identifier. The indication represents a definition of the information to be included in the published event. For example, a win event may comprise a win amount, a WGM identifier, a time/date stamp, a wagering game identifier, a name of a player, etc.

At block 307, the centralized event database sends a confirmation to the process that it has been registered as a publisher.

Figure 4:
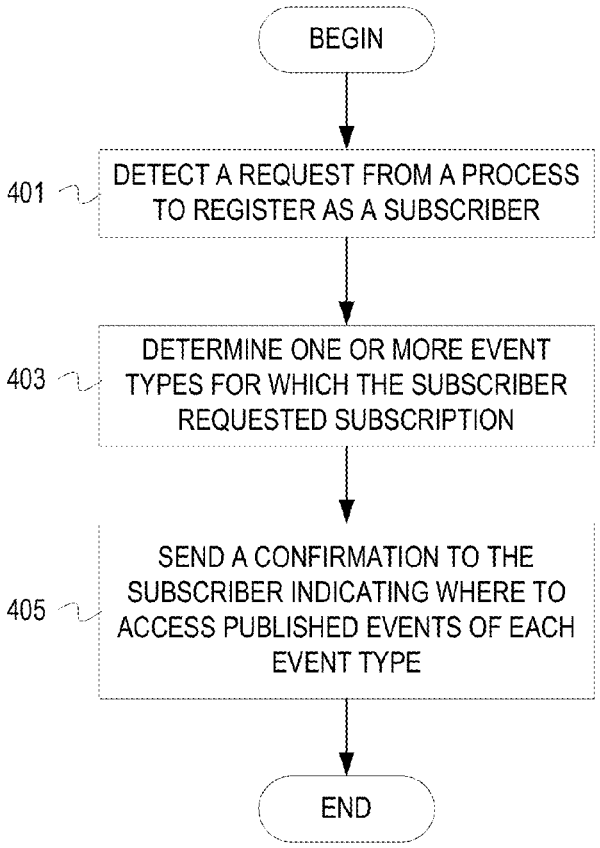
FIG. 4 is a flowchart depicting example operations for registering as a subscriber with a centralized event database.

The centralized event database manages events published by a plurality of publishers. The centralized event database facilitates subscription by allowing subscribers access to published events. FIG. 4 is a flowchart depicting example operations for registering as a subscriber with a centralized event database. Flow begins at block 401, where the centralized event database detects a request from a process to register as a subscriber. The request identifies the process and one or more event identifiers.

At block 403, the centralized event database determines one or more event types for which the subscriber requested subscription based on the one or more event identifiers in the request.

At block 405, the centralized event database sends a confirmation to the subscriber indicating where to access published events of each type. For example, the centralized event database grants the subscriber access to a file containing the published events to the subscriber. The process managing the centralized database can also notify the subscriber of previously published events of interest to the subscriber. As another example, the centralized event database returns a multicast internet protocol (IP) address that allows the subscriber to receive the published events. The subscriber may receive published events directly from one or more publishers or from the centralized event database. In some examples, more than one event type may be published in a single location (e.g., a file, a block of memory, a port, RSS feed, etc.). The subscriber is responsible for determining if a published event is relevant to the subscriber based on an event identifier. In other examples, a single event type is published in a single location. The centralized event database returns the location based on an event identifier in the subscription request.

As depicted in FIG. 2, subscribers detect when events are added to the centralized event database. The detection can be based on monitoring a location (e.g., a file, a block of memory, etc.), receiving a notification from the centralized event database, etc. In some examples, the centralized event database may send each subscriber a notification when any type of event is added. In other examples, the centralized event database may send a notification to a subscriber based on an event type. For example, a subscriber requested subscription to beverage order events. The centralized event database sends a notification to the subscriber when a beverage order event is added. In addition, the notification may or may not include information about the event. If the notification does not include the event information, the subscriber retrieves the event information based on access information returned by the centralized event database.

In some cases, a subscriber may want to subscribe to a subset of the published events of a certain type. For example, a subscriber wants to subscribe to beverage order events from WGMs in a particular section of a casino. The subscriber can include a location along with an event identifier in a subscription request to a centralized event database. The centralized event database can use the location to determine when a notification should be sent to the subscriber.

Figure 5:
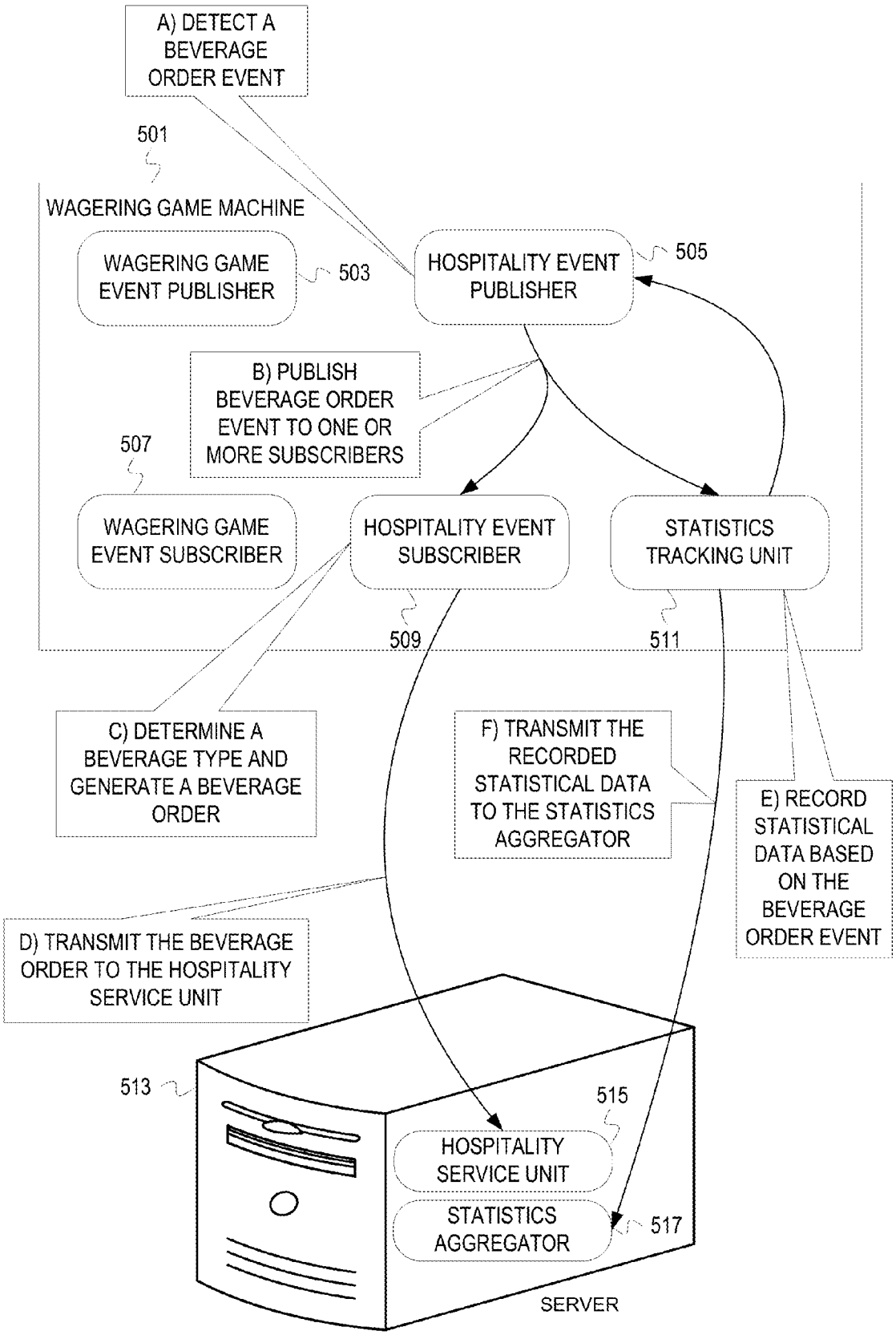
FIG. 5 is an example conceptual diagram depicting publishing events to a plurality of subscribers.

Although the above Figures depict examples of a publisher-subscriber architecture that utilizes a centralized posting facility for event information, embodiments are not so limited. Embodiments can implement the architecture with direct communications between publishers and subscribers, with centralized registration of publishers and subscribers without centrally storing event information, etc. FIG. 5 is an example conceptual diagram depicting publishing events to a plurality of subscribers. Two publisher processes, a wagering game event publisher 503 and a hospitality event publisher 505, are running on a WGM 501. Three subscriber processes, a wagering game event subscriber 507, a hospitality event subscriber 509, and a statistics tracking unit 511, are also running on the WGM 501. Although the subscriber processes are depicted as running on the WGM 501, embodiments are not so limited. The subscriber processes may be running on a server, a network device (e.g., a computer), etc. FIG. 5 also depicts a server 513 that hosts a hospitality service unit 515 and a statistics aggregator 517.

At stage A, the hospitality event publisher 505 detects a beverage order event. Detecting a beverage order comprises detecting an indication (e.g., a button push, a tap on a touch screen, etc.) by a player.

At stage B, the hospitality event publisher 505 publishes information about the beverage order event to one or more subscribers. In this example, the hospitality event publisher 505 publishes information about the beverage order event to the hospitality event subscriber 509 and the statistics tracking unit 511. The example presumes that the hospitality event subscriber 509 and the statistics tracking unit 511 have previously subscribed to hospitality events, beverage order events, and/or the hospitality event publisher 505. Example information published about the beverage event includes a beverage type, date/time stamp, a WGM identifier or location, a wagering game identifier, demographics of a player, etc.

At stage C, the hospitality event subscriber 509 receives the information published about the beverage order event and determines the beverage type based on the published information. For example, the beverage type may be a Margarita. The hospitality event subscriber 509 then generates a beverage order based on the published information. For example, the hospitality event subscriber 509 uses the beverage type and a player identifier from the published information to generate the beverage order.

At stage D, the hospitality event subscriber 509 transmits the generated beverage order based on the published beverage order event to the hospitality service unit 515. The hospitality service unit 515 requests that a bartender prepare the order and dispatches a member of a wait staff to deliver the beverage.

At stage E, the statistics tracking unit 511 receives the published event and records statistical data based on the beverage order event.

At stage F, the statistics tracking unit 511 transmits the recorded statistical data to the statistics aggregator 517. The statistics aggregator 517 aggregates statistical data from a plurality of statistics tracking units instantiated on multiple WGMs.

Figure 6:
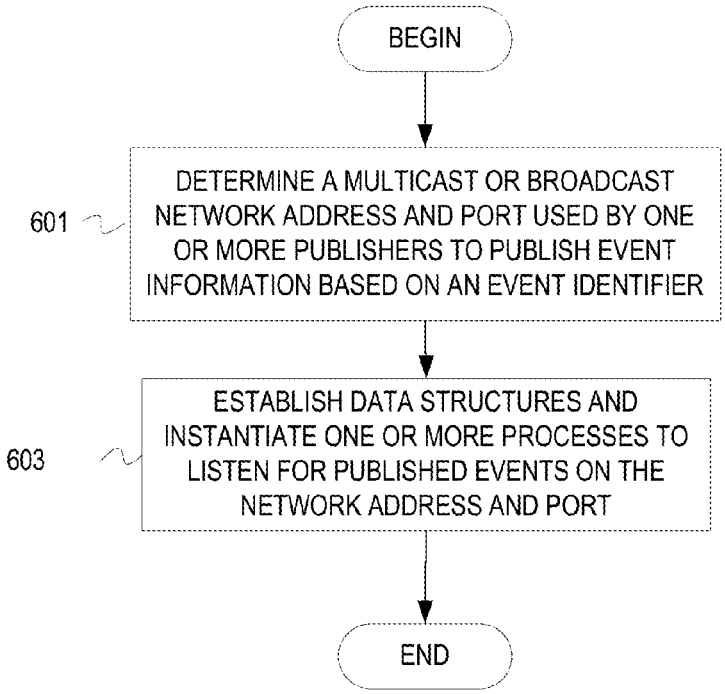
FIG. 6 is a flowchart depicting example operations for subscribing directly to a publisher for published events.

FIG. 6 is a flowchart depicting example operations for subscribing directly to a publisher for published events. Flow begins at block 601, where a subscriber determines a multicast or broadcast network address and port used by one or more publishers to publish event information based on an event identifier. For example, the subscriber accesses a table that associates multicast IP addresses and ports with event identifiers. The table may be hosted on a WGM hosting the subscriber, a server, etc. Multicast IP addresses may be associated with a publisher, an event type, etc.

At block 603, the subscriber establishes data structures and/or instantiates one or more processes to listen for published events on the network address and port. A single event type can be published to a single network address. For example, a subscriber sends an Internet Group Management Protocol membership message to a multicast router that has been configured to publish a particular type of event to a particular multicast network address. In another example, more than one event type may be published in a multicast group. For example, the subscriber joins a multicast group that receives publications of multiple types of events. The subscriber receives published events of the multiple types, and filters for the event type of interest, perhaps based on an event identifier.

The subscriber may examine event information in addition to the event identifier to determine if the event is relevant to the subscriber. For example, an interactive signage controller may subscribe to published win events. The interactive signage controller displays a replay of a win if the win is above a threshold. The interactive signage controller determines if the win exceeds the threshold based on a win amount published in the win event.

In some cases, subscribers may send a subscription request to a publisher process. The publisher process maintains contact information (e.g., an internet protocol address, an e-mail address, etc.) for each subscriber. A subscriber may access a database to determine which publishers are publishing events relevant to the subscriber. The subscriber sends subscription requests to publishers that publish relevant events.

Figure 7:
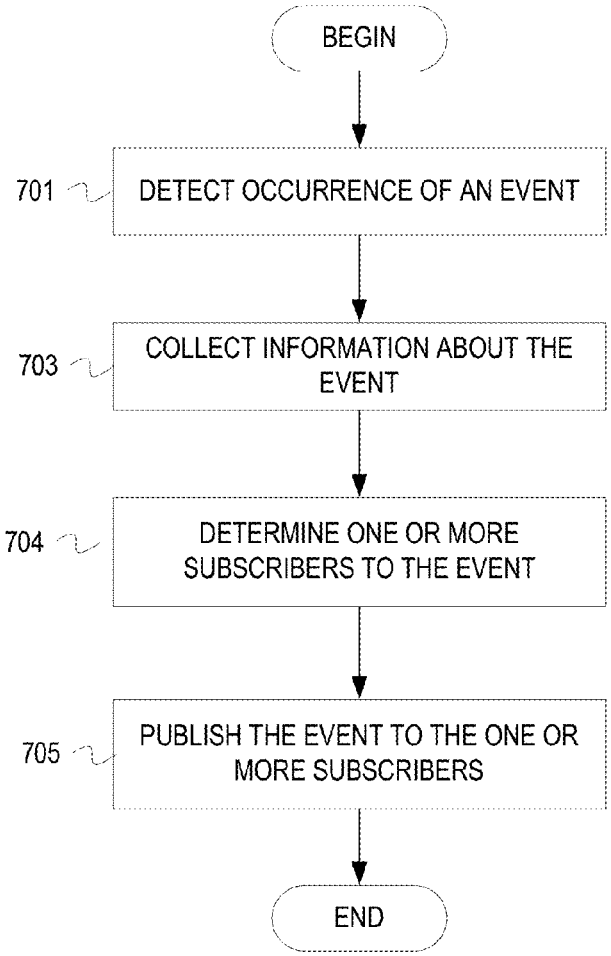
FIG. 7 is a flowchart depicting example operations for publishing an event directly to subscribers.

FIG. 7 is a flowchart depicting example operations for publishing an event directly to subscribers. Flow begins at block 701, where a publisher detects occurrence of an event. For example, the publisher detects a win on a WGM. Examples of events include a win, a wager, a beverage order, a game condition, etc.

At block 703, the publisher collects information about the event. For example, the event is a wager. Collected information may include a wager amount, a player identifier, a time/date stamp, a WGM identifier, a wagering game title, etc.

At block 704, the publisher determines one or more subscribers to the event. For instance, the publisher accesses a locally maintained data structures that indicates network addresses, ports, and process identifiers of subscribers interested in the event. In another example, the publisher determines that the event is published over an established socket.

At block 705, the publisher publishes the event to the determined one or more subscribers. For example, the publisher publishes a wager event to an accounting server and an advertisement unit. The accounting server debits the wager from a wagering account of a player. The advertisement unit causes the wagering game machine to display information about a loyalty club if the wager is above a threshold.

Figure 8:
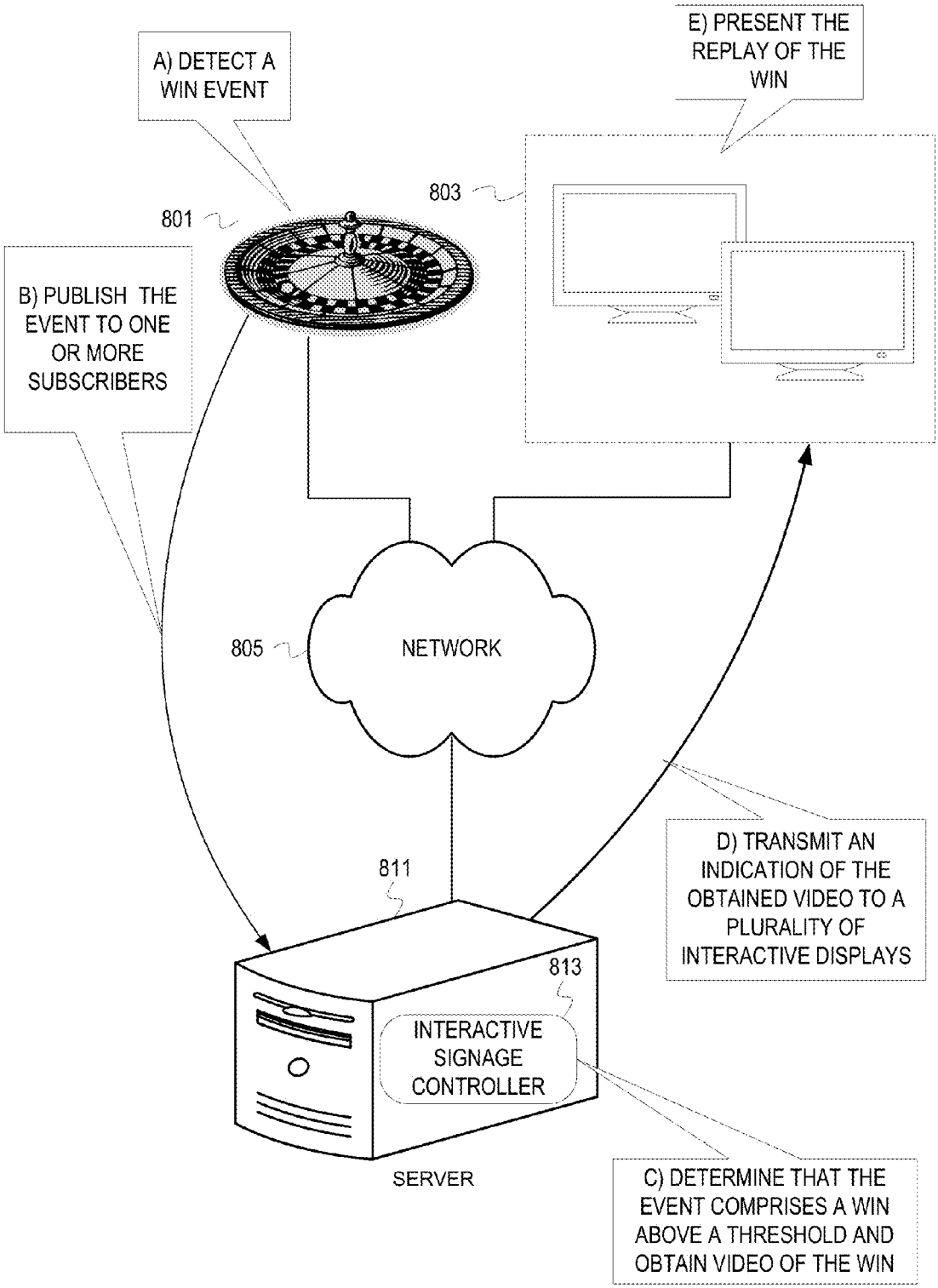
FIG. 8 is an example conceptual diagram of replaying a win across multiple devices based on a published win event.

Published events may be used in a variety of different ways. FIGS. 8-11 depict examples of using published events. FIG. 8 is an example conceptual diagram of replaying a win across multiple devices based on a published win event. At stage A, a win event is detected at a roulette wheel 801. For example, electronic sensors and software at the roulette wheel 801 detect a win and generates data about the win. A win publisher examines the generated data and determines that the win is above a given threshold. The win publisher generates an event that indicates the win, win amount, and roulette wheel 801.

At stage B, the win publisher publishes the roulette win event to one or more subscribers. In this example, the win publisher provides data that indicates the win amount (or indication that the threshold was exceeded), game type, time of the win, and location of the roulette wheel 801 to an interactive signage controller 813 running on a server 811.

At stage C, the interactive signage controller 813 receives the data provided by the win publisher. The interactive signage controller 813 determines that a threshold condition is satisfied based on the data provided by the win publisher (e.g., compares the win amount against the threshold, recognizes a threshold exceeded flag, etc.). The threshold may be a default value, a dynamic value that changes based on conditions in a casino (e.g., time of day, number of patrons, etc.). The interactive signage controller 813 then obtains a video of the win. For instance, the interactive signage controller 813 uses the location of the roulette wheel 801 and the win time to request a video segment from a repository of security video. A backend system provides a given segment of video from a camera monitoring the roulette wheel 801 based on the win time and a presumed window of time (e.g., several seconds prior and subsequent to the indicated win time).

At stage D, the interactive signage controller 813 transmits an indication of the video segment to a plurality of interactive displays 803. The interactive signage controller 813 may send the video segment, a location of the video segment, etc. Examples of interactive displays include a television, a secondary display on a WGM, a projector, etc.

At stage E, the plurality of interactive displays presents the video segment of the win.

Figure 9:
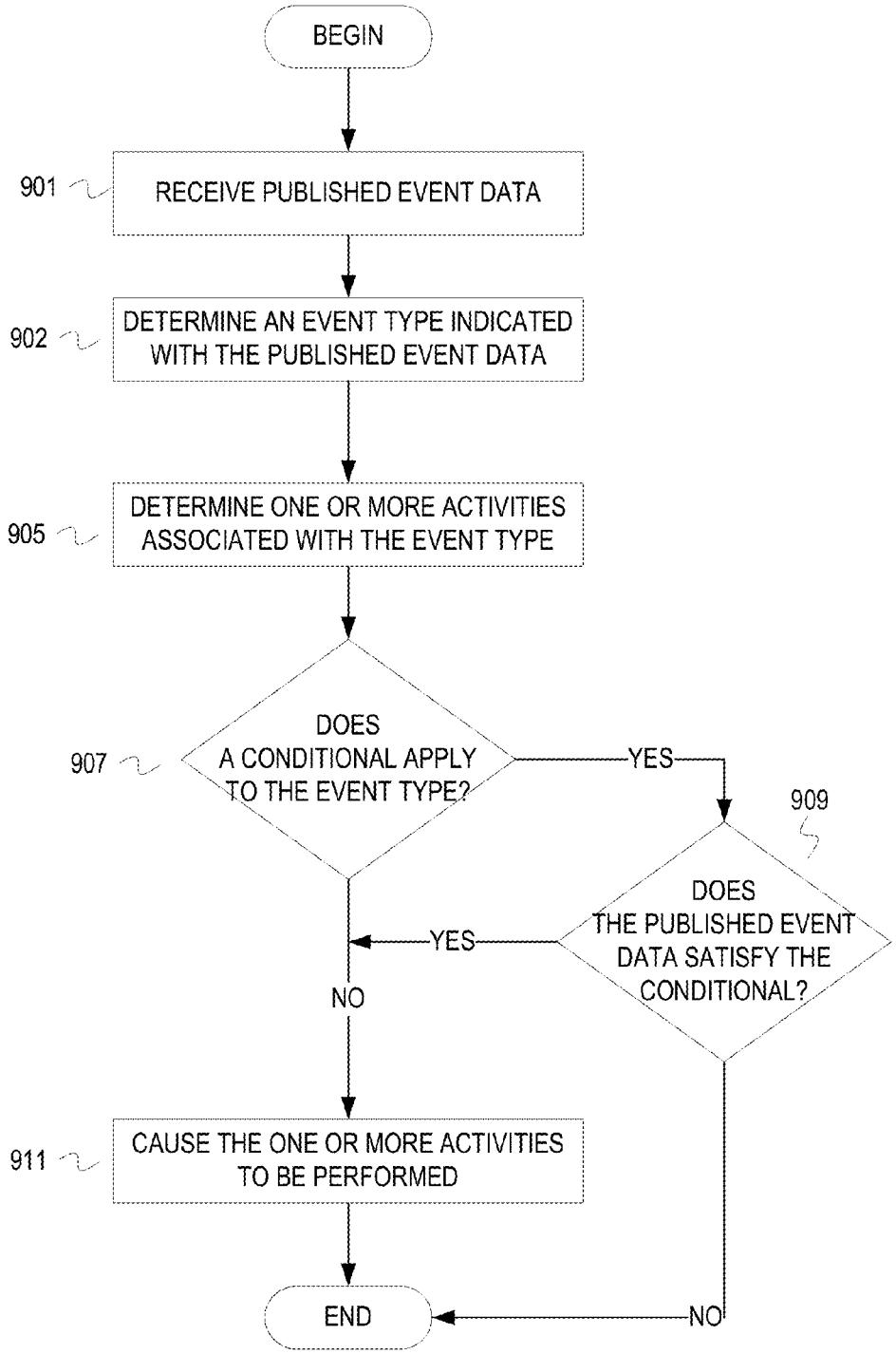
FIG. 9 is a flowchart depicting example operations for responding to receiving published event data.

FIG. 9 is a flowchart depicting example operations for responding to receiving published event data. At block 901, published event data is received. For example, a message is received from a publisher.

At block 902, an event type is indicated with the published event data is determined. For instance, an event identifier that corresponds to an event type or an indication of an event type is recognized in a message providing the published event data.

At block 905, one or more activities associated with the determined event type are determined. For example, a subscriber accesses a data structure indexed by event type indicators. Each entry indicates one or more activities (e.g., scripts, executable code, function pointers, application programming interface call, etc.).

At block 907, it is determined if a conditional applies to the determined event type. For example, a subscriber determines that an entry accessed with the event type indicator indicates one or more conditionals. Embodiments can implement evaluation of the conditional(s) in code executed responsive to the published event. If a conditional applies, then control flows to block 909. If a conditional does not apply, then control flows to block 911.

At block 909, it is determined if the published event data satisfies the conditional. For example, it is determined if a win amount exceeds a threshold. If the published event data satisfies the conditional, then control flows to block 911. If the published event data does not satisfy the conditional, then the flow ends.

At block 911, the one or more activities associated with the event type are caused to be performed. For example, a subscriber executes associated executable code or script, invokes a code unit, transmits a message, transmits a command message, etc.

The depicted flow diagrams are examples meant to aid in understanding embodiments and should not be used to limit the embodiments. Embodiments may perform additional operations, fewer operations, operations in a different order, operations in parallel, and some operations differently. For instance, additional operations may be performed in FIG. 9 to evaluate additional conditionals.

Figure 10:
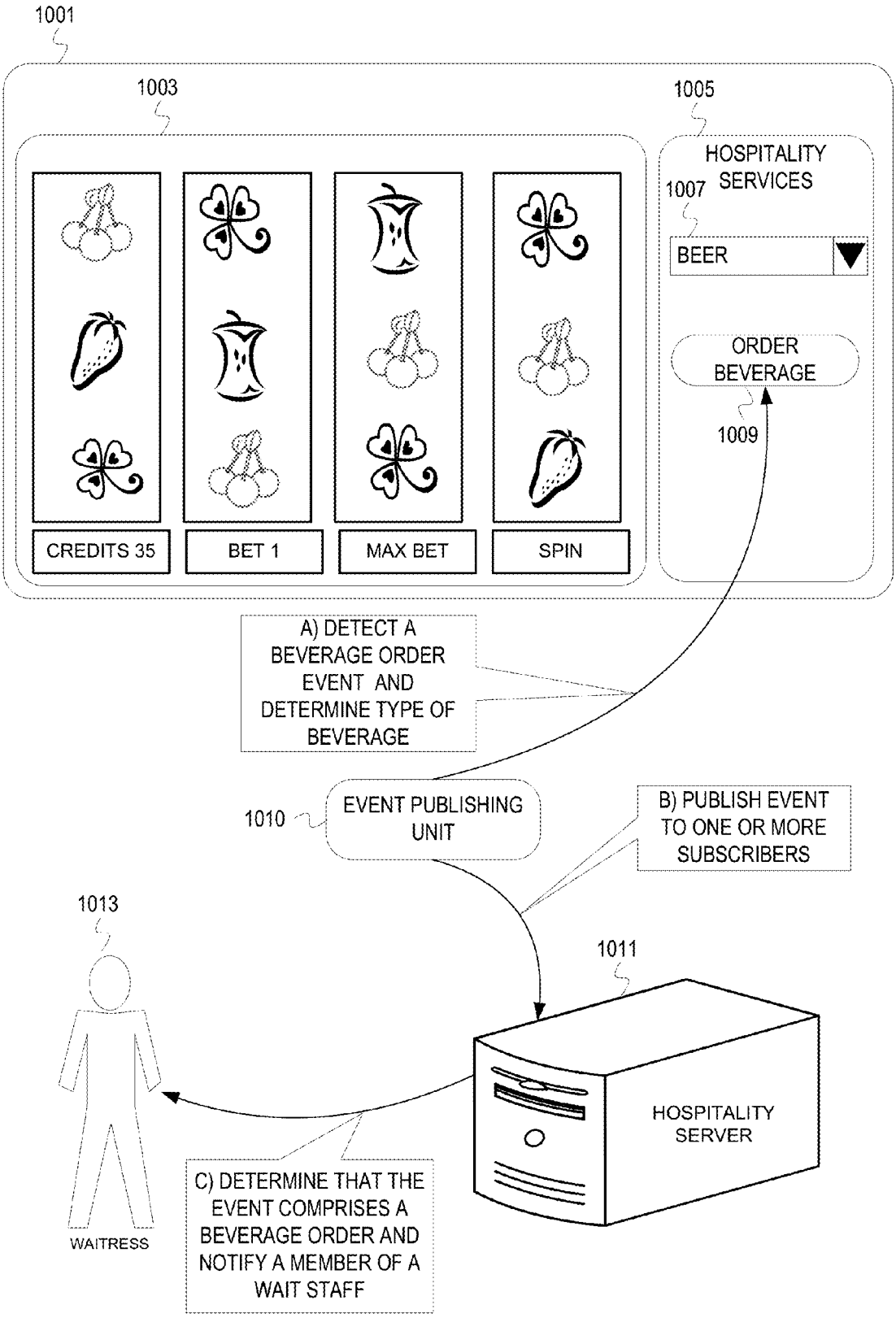
FIG. 10 is an example conceptual diagram of filling a beverage order based on a published beverage order event.

FIG. 10 is an example conceptual diagram of filling a beverage order based on a published beverage order event. A screen snapshot 1001 from a WGM comprises a wagering game display area 1003 and a hospitality services area 1005. The hospitality services area 1005 comprises a beverage type drop down list 1007 and an order beverage button 1009.

At stage A, an event publishing unit 1010 detects a beverage order event and determines a type of beverage. In this example, the event publishing unit 1010 detects a click on the order beverage button 1009. The event publishing unit 1010 determines the type of beverage based on a value indicated with the beverage type drop down list 1007.

At stage B, the event publishing unit 1010 publishes the event to one or more subscribers. In this example, the event publishing unit 1010 publishes the event to a hospitality server 1011.

At stage C, the hospitality server 1011 determines that the event comprises a beverage order and notifies a member of a wait staff 1013 to fill the order. The hospitality server 1011 may display the order on an order terminal, e-mail the order to a personal digital assistant of the member of the wait staff 1013, etc.

Figure 11:
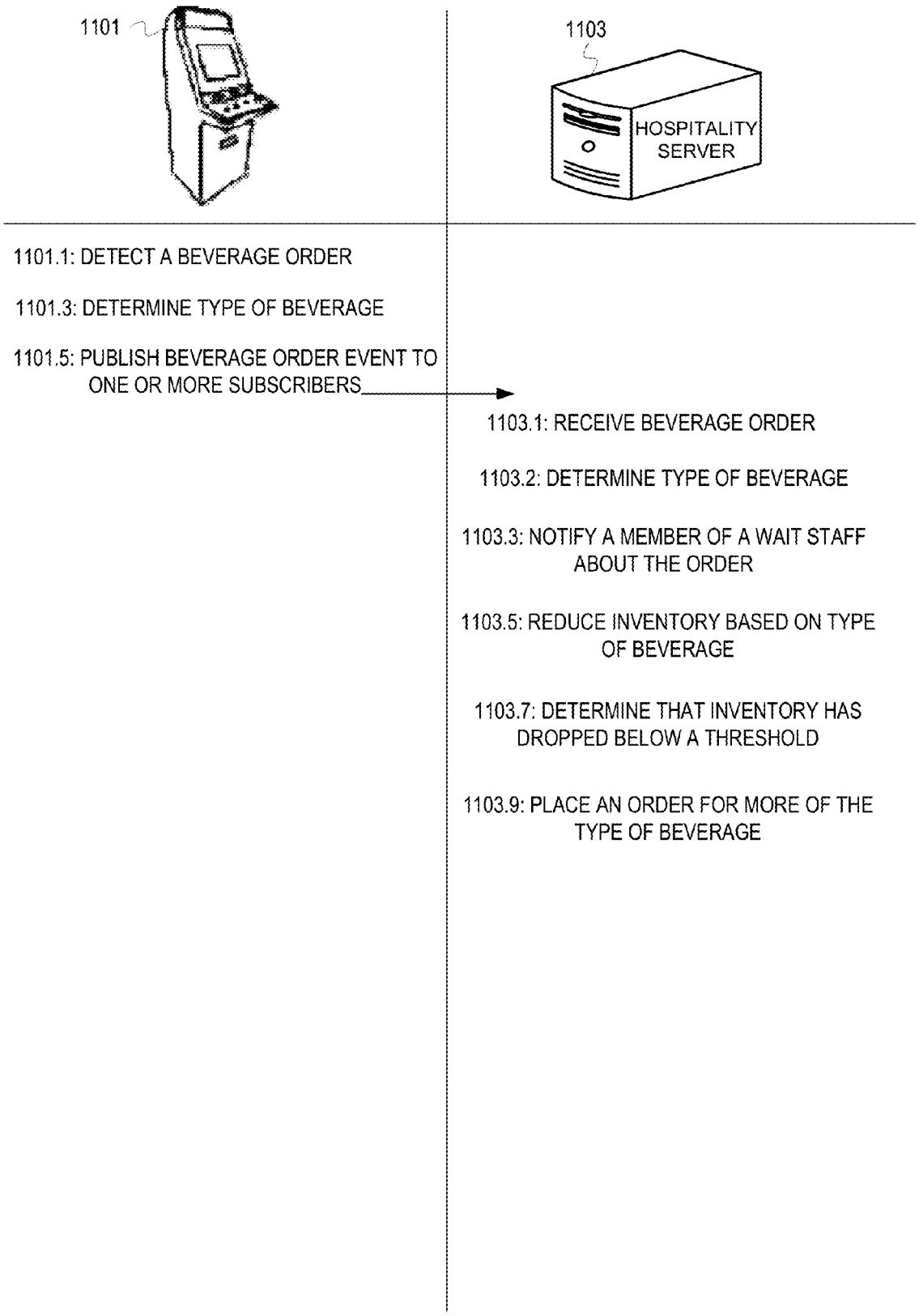
FIG. 11 is an example conceptual diagram depicting operations for causing one or more activities to be performed based on a beverage order event being published.

FIG. 11 is an example conceptual diagram depicting operations for causing one or more activities to be performed based on a beverage order event being published. At 1101.1 a publisher process on a WGM 1101 detects a beverage order. For example, the publisher process detects a tap on an icon presented on a touch screen of WGM 1101.

At stage 1101.3, the publisher process determines a type of beverage. In the previous example, the publisher process determines a beverage type associated with the tapped icon.

At stage 1101.5, the publisher process publishes the beverage order event to one or more subscribers. For example, the publisher process multicasts data about the beverage order event to a multicast group.

At stage 1103.1, a hospitality server 1103 receives the beverage order event data.

At stage 1103.2, the hospitality server 1103 determines the type of beverage based on the beverage order event data. For example, the type of beverage is a Bud Light® beer.

At stage 1103.3, the hospitality server 1103 notifies a member of a wait staff about the order. In response, the member of the wait staff prepares and delivers the ordered beverage. For example, the hospitality server 1103 sends the order via a short message service (SMS) text message to a mobile phone of a waitress.

At stage 1103.5, the hospitality server 1103 reduces inventory based on the type of beverage.

At stage 1103.7, the hospitality server 1103 determines that inventory has dropped below a threshold.

At stage 1103.9, the hospitality server 1103 places an order for more of the type of beverage.

Although the depicted examples are set within a wagering game establishment, publisher/subscriber processes within a wagering game network of a wagering game establishment can interact with processes external to the wagering game network. For instance, a hierarchy of processes can establish publisher/subscriber relationships for events related to an online social network. Assume Kim, Cat, and Chris are friends in an online social network. These friends have friend lists that can be imported into a wagering game establishment.

Kim opens her friend list, which indicates Cat and Chris, on a first wagering game machine in a wagering game establishment. A first subscriber process associated with the friend list registers with a publisher/subscriber friend manager on a server in the wagering game network of the wagering game establishment. The first subscriber process registers interest in Cat and Chris.

The publisher/subscriber friend manager updates a structure to indicate registration of the first subscriber process. The publisher/subscriber friend manager then communicates with a publisher process of the online social network to register interest in events generated by Chris or Cat. The social network publisher process updates a structure to indicate the subscription of the publisher/subscriber friend manager. The social network publisher also records an indication that the publisher/subscriber manager is aware of Kim.

Cat logs into a second wagering game machine in the wagering game establishment, thus generating a login event. The publisher/subscriber friend manager detects the login event generated by Cat, and publishes the login event to Kim. Kim's friends list may be updated with a status for Cat that indicates the wagering game establishment.

After logging in, Cat opens her friend list on the second wagering game machine. A second subscriber process associated with Cat's friend list registers with the publisher/subscriber friend manager. The second subscriber process registers interest in events generated by Kim and Cat.

The publisher/subscriber friend manager updates a structure to indicate registration of the second subscriber process. The publisher/subscriber friend manager then provides communication information to the first subscriber and the second subscriber processes for the first and second subscriber processes to communicate with each other. With the communication information, the first and second subscriber processes also operate as publisher processes, and publish events to each other.

The publisher/subscriber friend manager subscribes to the social network publisher to receive publications of events generated by Kim and Chris. The online social network publisher process updates a structure to indicate the subscription. If Kim were to log out of the first wagering game machine and log into the online social network while the subscription remained, the online social network publisher process would publish events generated by Kim to the publisher/subscriber friend manger. For now, the online social network publisher process records an indication that the publisher/subscriber friend manager is aware of Cat.

Chris logs into a computer and launches her friend list, which indicates Kim and Cat. The online social network publisher process detects a login event generated by Chris, and publishes the login event to the publisher/subscriber friend manager. The publisher/subscriber friend manager then publishes the login event to the first and second subscriber processes at the first and the second wagering game machines.

A third subscriber process associated with Chris' friend list subscribes with the publisher/subscriber friend manager to events generated by Cat and Kim. The third subscriber process can subscribe directly with the publisher/subscriber friend manager (e.g., using information provided by the online social network publisher process) or via the online social network publisher process, which then begins to operate as a subscriber as well as a publisher.

If Kim generates a win event, a replay of the winning spin can be pushed to Chris and Cat. The second subscriber process can receive a publication of the win event and determine one or more activities to perform on the second wagering game machine to replay the winning spin. The third subscriber process also receives a publication of the win event. The third subscriber can request the winning spin replay from the wagering game network, directly or indirectly, and play the winning spin on the computer.

The publisher/subscriber friend manager can also coordinate activities across the second wagering game machine and the computer. The second and third subscriber processes can update status for Kim to indicate her win. The publisher/subscriber friend manager can pull the winning spin replay from the first wagering game machine, and push it to the second wagering game machine and the computer. The publisher/subscriber friend manager can also temporarily open a video chat on the first wagering game machine with Chris and Cat.

Numerous variations are possible with just the social network example. Embodiments can coordinate a variety of activities in response to notification of events. Furthermore, embodiments can employ multicasting and broadcasting techniques to inform interested entities of particular events. A user can configure a subscriber process to filter out certain events.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system". Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine-readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

Computer program code for carrying out operations of the embodiments may be written in any combination of one or more programming languages, including an object oriented programming language such as Java, Smalltalk, C++ or the like and conventional procedural programming languages, such as the "C" programming language or similar programming languages. The program code may execute entirely on a user's computer, partly on the user's computer, as a standalone software package, partly on the user's computer and partly on a remote computer or entirely on the remote computer or server. In the latter scenario, the remote computer may be connected to the user's computer through any type of network, including a local area network (LAN), a personal area network (PAN), or a wide area network (WAN), or the connection may be made to an external computer (for example, through the Internet using an Internet Service Provider).

Wagering Game Machine Architectures

Figure 12:
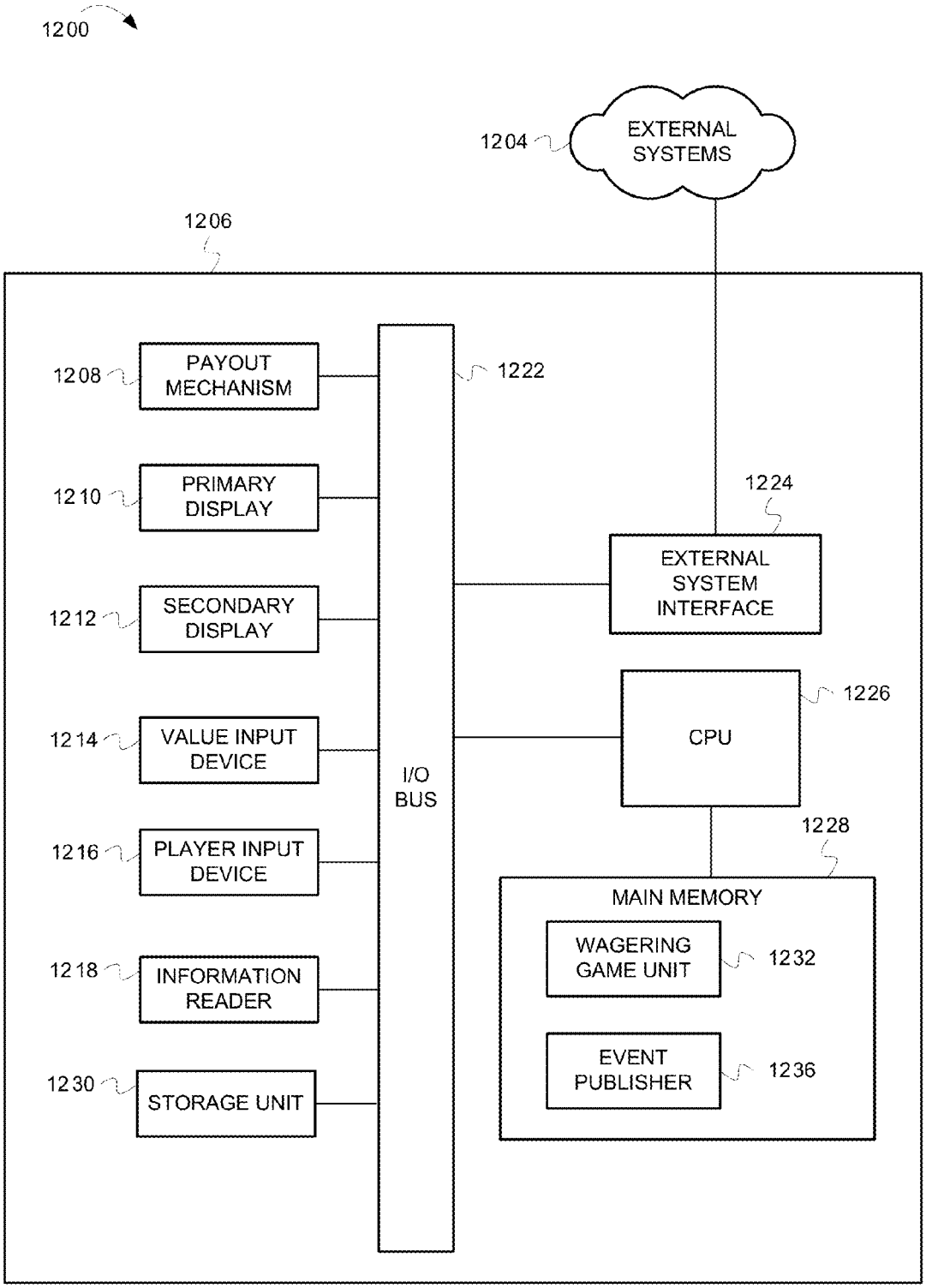
FIG. 12 is a block diagram illustrating a wagering game machine architecture, according to example embodiments of the invention.

FIG. 12 is a block diagram illustrating a wagering game machine architecture, according to example embodiments of the invention. As shown in FIG. 12, the wagering game machine architecture 1200 includes a wagering game machine 1206, which includes a central processing unit (CPU) 1226 connected to main memory 1228. The CPU 1226 can include any suitable processor, such as an Intel® Pentium processor, Intel® Core 2 Duo processor, AMD Opteron™ processor, or UltraSPARC processor. The main memory 1228 includes a wagering game unit 1232. In one embodiment, the wagering game unit 1232 can present wagering games, such as video poker, video black jack, video slots, video lottery, etc., in whole or part. The main memory 1228 also includes an event publisher 1236 that detects that an event has occurred, collects information about the event and publishes the event to one or more subscribers. The main memory 1228 can also embody an event subscriber that subscribes to events published by the event publisher 1236. Further, the event publisher 1236 may also be configured to operate as a subscriber. For instance, a process can subscribe to all win events, and publish an event for win events above a particular threshold.

The CPU 1226 is also connected to an input/output (I/O) bus 1222, which can include any suitable bus technologies, such as an AGTL+ frontside bus and a PCI backside bus. The I/O bus 1222 is connected to a payout mechanism 1208, primary display 1210, secondary display 1212, value input device 1214, player input device 1216, information reader 1218, and storage unit 1230. The player input device 1216 can include the value input device 1214 to the extent the player input device 1216 is used to place wagers. The I/O bus 1222 is also connected to an external system interface 1224, which is connected to external systems 1204 (e.g., wagering game networks).

In one embodiment, the wagering game machine 1206 can include additional peripheral devices and/or more than one of each component shown in FIG. 12. For example, in one embodiment, the wagering game machine 1206 can include multiple external system interfaces 1224 and/or multiple CPUs 1226. In one embodiment, any of the components can be integrated or subdivided.

Any component of the architecture 1200 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

While FIG. 12 describes an example wagering game machine architecture, this section continues with a discussion wagering game networks.

Wagering Game Networks

Figure 13:
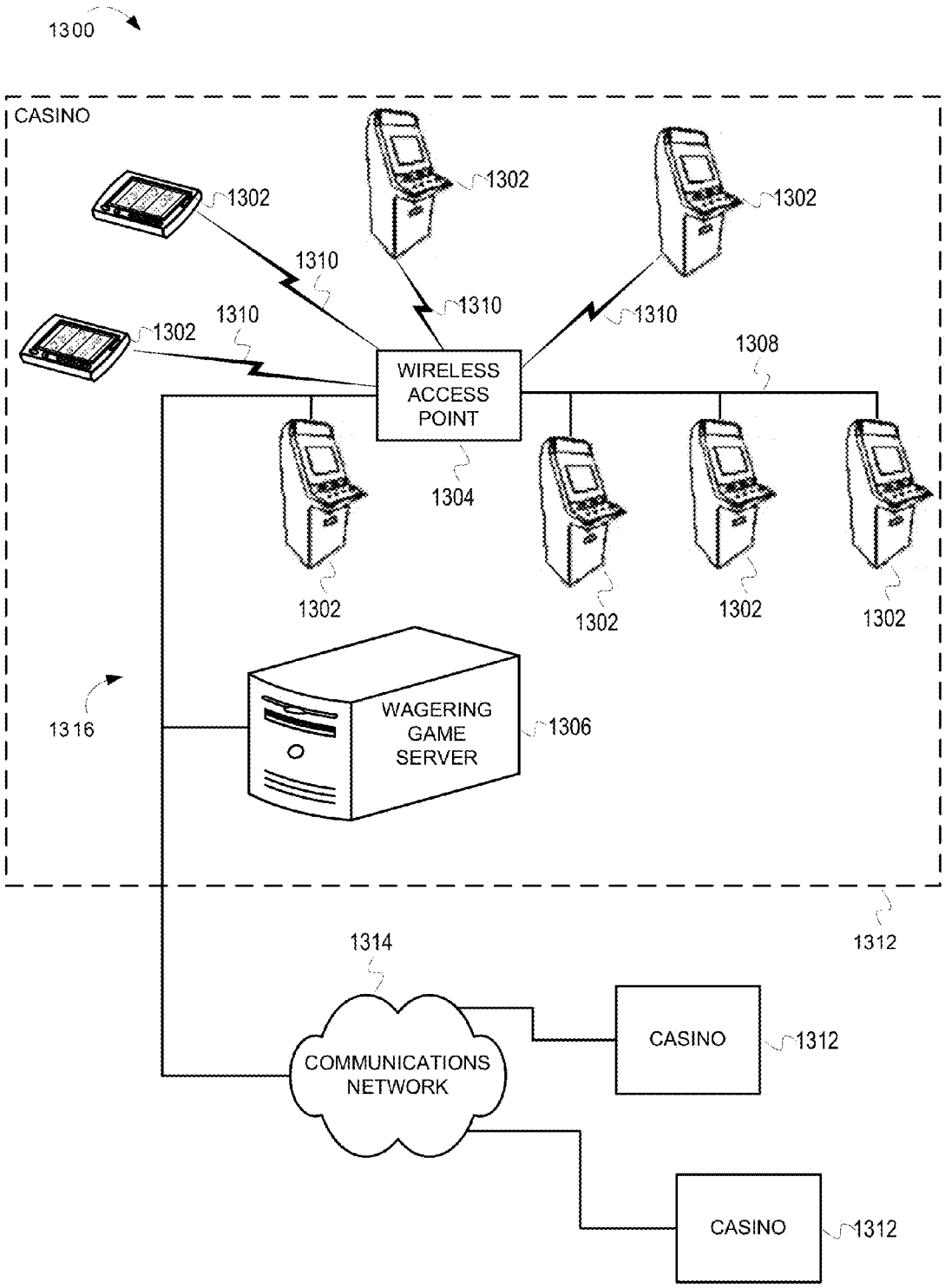
FIG. 13 is a block diagram illustrating a wagering game network 1300, according to example embodiments of the invention.

FIG. 13 is a block diagram illustrating a wagering game network 1300, according to example embodiments of the invention. As shown in FIG. 13, the wagering game network 1300 includes a plurality of casinos 1312 connected to a communications network 1314.

Each casino 1312 includes a local area network 1316, which includes an access point 1304, a wagering game server 1306, and wagering game machines 1302. The access point 1304 provides wireless communication links 1310 and wired communication links 1308. The wired and wireless communication links can employ any suitable connection technology, such as Bluetooth, 802.11, Ethernet, public switched telephone networks, SONET, etc. In some embodiments, the wagering game server 1306 can serve wagering games and distribute content to devices located in other casinos 1312 or at other locations on the communications network 1314.

The wagering game machines 1302 described herein can take any suitable form, such as floor standing models, handheld mobile units, bartop models, workstation-type console models, etc. Further, the wagering game machines 1302 can be primarily dedicated for use in conducting wagering games, or can include non-dedicated devices, such as mobile phones, personal digital assistants, personal computers, etc. In one embodiment, the wagering game network 1300 can include other network devices, such as accounting servers, wide area progressive servers, player tracking servers, and/or other devices suitable for use in connection with embodiments of the invention.

In some embodiments, wagering game machines 1302 and wagering game servers 1306 work together such that a wagering game machine 1302 can be operated as a thin, thick, or intermediate client. For example, one or more elements of game play may be controlled by the wagering game machine 1302 (client) or the wagering game server 1306 (server). Game play elements can include executable game code, lookup tables, configuration files, game outcome, audio or visual representations of the game, game assets or the like. In a thin-client example, the wagering game server 1306 can perform functions such as determining game outcome or managing assets, while the wagering game machine 1302 can present a graphical representation of such outcome or asset modification to the user (e.g., player). In a thick-client example, the wagering game machines 1302 can determine game outcomes and communicate the outcomes to the wagering game server 1306 for recording or managing a player's account.

In some embodiments, either the wagering game machines 1302 (client) or the wagering game server 1306 can provide functionality that is not directly related to game play. For example, account transactions and account rules may be managed centrally (e.g., by the wagering game server 1306) or locally (e.g., by the wagering game machine 1302). Other functionality not directly related to game play may include power management, presentation of advertising, software or firmware updates, system quality or security checks, etc.

One or more publisher and/or subscriber processes may be running on wagering game server 1306. The publisher processes detect occurrence of an event, collect information about the event and publish information to one or more subscribers. The subscriber processes receive a first published event and initiate a second event based on the type of the first event.

Any of the wagering game network components (e.g., the wagering game machines 1302) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method of operating a wagering game server, said method comprising:

receiving, via a network communication interface of the wagering game server, a first request to register a first process as a publisher via a wagering game network, wherein the first request is initiated by a first of a plurality of wagering game machines within the wagering game network, wherein each of the plurality of wagering game machines includes a value input device configured to accept monetary value for placement of wagers on one or more casino wagering games;

in response to receiving the first request, determining one or more first event types associated with casino wagering games to be published by the first process via the first of the plurality of wagering game machines based, at least in part, on one or more first event identifiers indicated by the first request;

for each of the one or more first event identifiers, storing an indication of information to be published by the first process when a wagering game event corresponding to the one or more first event identifiers occurs, and storing an indication of the first process;

electronically determining that the first of the plurality of wagering game machines is associated with a second of the plurality of wagering game machines via a social network associated with a social network server external to the wagering game network;

receiving, via the network communication interface, a second request to register a second process associated with the second of the plurality of wagering game machines as a subscriber of social-network events for a social contact of the social network, wherein the social-network events are related to the one or more first event types to be published by the first process via the first of the plurality of wagering game machines;

in response to receiving the second request, for each social-network event type indicated in the second request, registering the second process as a subscriber; and providing a notification to the second of the plurality of wagering game machines in response to detecting a social-network event published via the first of the plurality of wagering game machines via the social network, wherein the social-network event is of the social-network event type.

2. The method of claim 1, wherein the first of the plurality of wagering game machines is associated with a first of a plurality of wagering game player accounts, wherein a list of social contacts of the social network is indicated by the first of the plurality of wagering game player accounts, and wherein the electronically determining that the first of the plurality of wagering game machines is associated with the second of the plurality of wagering game machines via the social network comprises:

electronically evaluating, via an electronic processing unit of the wagering game server, the list of social contacts against the plurality of wagering game player accounts, wherein the plurality of wagering game player accounts are associated with the plurality of wagering game machines; and determining that the one of the social contacts is associated with a second of the plurality of the wagering game player accounts associated with the second of the plurality of wagering game machines.

3. The method of claim 1, wherein the social-network event published via the first of the plurality of wagering game machines via the social network indicates a win event published by the first process, wherein the win event occurred at the first of the plurality of wagering game machines, and wherein the providing the notification to the second of the plurality of wagering game machines comprises providing a video replay of the win event.

4. The method of claim 3 further comprising:

in response to detecting the win event, determining a location of the first of the plurality of wagering game machines inside a casino;

obtaining, via a subscription to a third process associated with a security camera at the location inside the casino, a video recording for a time that corresponds to the win event; and publishing, via a fourth process, the video recording to the second of the plurality of wagering game machines.

5. The method of claim 1, wherein the social-network event published via the first of the plurality of wagering game machines via the social network indicates a game event published by the first process, wherein the game event occurred at the first of the plurality of wagering game machines, and wherein the providing the notification to the second of the plurality of wagering game machines comprises automatically opening a chat feature between the first of the plurality of wagering game machines and the second of the plurality of wagering game machines in response to the social-network event.

6. One or more non-transitory, machine-readable storage media having program instructions stored thereon that are executable by a processor of a wagering game server, the program instructions comprising program instructions to:

electronically connect, via a communication network interface of the wagering game server, devices in a wagering game network;

determine one or more event types to be published by a first process associated with a first device in a casino based, at least in part, on one or more event identifiers indicated in a first request to register the first process as a publisher in the wagering game network, wherein the first device includes a value input device configured to accept monetary value for placement of wagers on one or more casino wagering games;

for each of the one or more event identifiers, store an indication of the first process;

store an indication of information to be published by the first process when an event corresponding to the event identifier occurs;

for each event type indicated in a second request to register a second process as a subscriber in the wagering game network, indicate the second process as a subscriber to the event type, wherein the second process is associated with a second device;

detect, via the first process, an occurrence of a wagering game event at a location in the casino associated with the first device, wherein the wagering game event is of the event type;

determine that the wagering game event exceeds a threshold associated with a casino condition at the location;

determine that the second device is associated with the location;

obtain, via the second process, content from the second device for a time that corresponds to the wagering game event; and publish the content via the first process.

7. A wagering game server comprising:

a processor;

a network communication interface configured to connect devices in a wagering game network; and one or more memory storage devices having program instructions stored thereon that are executable by the processor to cause the wagering game server to, determine one or more event types to be published by a first process based, at least in part, on one or more event identifiers indicated in a request to register the first process as a publisher in the wagering game network, wherein the first process is associated with a first device from a first vendor, wherein the first device includes a value input device configured to accept monetary value for placement of wagers on one or more casino wagering games, for each of the one or more event identifiers, store an indication of the first process, store an indication of information to be published by the first process when an event corresponding to the event identifier occurs, for each event type indicated in a request to register a second process as a subscriber in the wagering game network, indicate the second process as a subscriber to the event type, wherein the second process is associated with a second device from a second vendor different from the first vendor, in response to occurrence of the event corresponding to the event type published via the first process, determine a format associated with the second vendor, and provide, via the second process, an indication of the event in the format.

* * * * *